US006097267A

United States Patent [19]

Hampel

[11] Patent Number: 6,097,267

[45] Date of Patent: Aug. 1, 2000

[54] PHASE-TUNABLE ANTENNA FEED NETWORK

[75] Inventor: Karl Georg Hampel, New York, N.Y.

[73] Assignee: Lucent Technologies Inc., Murray Hill, N.J.

[21] Appl. No.: 09/148,449

[22] Filed: Sep. 4, 1998

[51] Int. Cl.[7] ..... H01P 1/18; H01P 5/12

[52] U.S. Cl. ..... 333/128; 333/161; 342/375

[58] Field of Search ..... 333/156, 159, 333/160, 161, 164, 263, 124, 125, 127, 128; 342/368, 375

[56] References Cited

U.S. PATENT DOCUMENTS

| | | | |
|---|---|---|---|
| 2,897,460 | 7/1959 | La Rosa | 333/263 X |
| 3,081,440 | 3/1963 | Augustine et al. | 333/160 |
| 4,602,227 | 7/1986 | Clark et al. | 333/160 X |
| 5,905,462 | 5/1999 | Hampel et al. | 333/159 X |
| 5,940,030 | 8/1999 | Hampel et al. | 342/368 X |

FOREIGN PATENT DOCUMENTS

| | | | |
|---|---|---|---|
| 6901 | 1/1986 | Japan | 333/160 |

*Primary Examiner*—Paul Gensler
*Attorney, Agent, or Firm*—Gibbon, Del Deo, Dolan Griffinger & Vecchione

[57] ABSTRACT

The invention is a device that provides a phase-tunable antenna feed network that allows beam-steering and beam-width variation with simple actuation, at low cost, and with high rf performance. The device provides a series-feed where signal power splitters and phase-shifters are alternately disposed in series. Each phase-shifter consists of reflection-mode phase-shifter elements that operate in conjunction with an isolation device. This avoids the critical resonance condition between periodically aligned phase-shifters over the entire tuning range, since the isolation devices can easily be matched and/or aligned with non-resonant spacing. The main feed-line interconnections have the same impedance, thereby enabling the utilization of the same phase-shifter design for the entire network. Moreover, a common driving mechanism can be used for the phase-shifters to steer the antenna beam. Splitting the array into two sub-arrays with individual collective driving mechanism further allows beam-width variation by steering the beams of both sub-arrays in opposite directions. The device is further compatible with symmetrical series network designs that have better frequency response. The series feed network preferably uses a phase-shifter for shifting a signal propagating through a transmission line by moving a conductive construct between an active line and a ground plane of the transmission line. The conductive construct capacitively couples with either the active line and/or the ground plane, forming a capacitive shunt that reflects a significant part of the signal. The remaining portion of the signal is reflected at a terminated end of the transmission line, resulting in substantially no signal loss.

46 Claims, 13 Drawing Sheets

PHASE-TUNABLE ANTENNA FEED NETWORK

RELATED APPLICATIONS

The present patent application is related to U.S. patent application Ser. No. 09/148,442, entitled, "REFLECTION MODE PHASE SHIFTER", being concurrently filed herewith and having a filing date of Sep. 4, 1998, and having a common inventor and assignee and being incorporated herein by reference.

FIELD OF THE INVENTION

The present invention relates to telecommunications. More particularly, the present invention relates to a phase-tunable antenna feed network.

BACKGROUND OF THE INVENTION

There has been explosive growth in the area of wireless communications. A few years ago, the sight of a person speaking into a cellular phone was a curiosity while today, it is commonplace. Communication via cellular phones is supported by wireless telecommunications systems. Such systems service a particular geographic area that is partitioned into a number of spatially-distinct areas called "cells." Each cell usually has an irregular shape (though idealized as a hexagon) that depends on terrain topography. Typically, each cell contains a base station, which includes, among other equipment, receive and transmit antennas that the base station uses to communicate with the wireless terminals (e.g., cellular phones) in that cell. Each antenna is characterized by its individual radiation pattern, which determines the signal coverage area and therefore range and shape of the cell.

Due to instantaneous geographic variations in communications traffic, it is desirable, at times, to adjust the geographic coverage of a particular base station. This can be accomplished by dynamically adjusting the antenna radiation pattern. The advantages of such dynamic adjustment, however, have to be weighed against the corresponding implementation costs. To be competitive, this technology therefore has to be cheap, small, and reliable.

Flat-panel array antennas are typically used for base station antennas. The flat-panel array antenna consists of several radiating antenna elements. The radiation patterns are determined by the collective action of all the radiating elements in the array. Usually, the radiation pattern is characterized by a main lobe and side lobes. In most cases, it is desirable to have a very narrow main lobe, also called an "antenna beam", in one or both angular dimensions. The advantage of this is that the antenna beam is very directive, and the angular power density in the main lobe is very high. The enhancement of main-lobe power density with shrinking beam width is also called "antenna gain". Thereby, the number of array elements in each physical dimension and their spacing determines the maximal achievable gain.

In order to obtain a wide variation of radiation patterns for a given antenna array, signal amplitude and signal phase of each individual array element have to be tunable. In real applications, however, only a few basic beam-pattern alterations are important. This reduces the amount of controllable parameters significantly. In most cases, it is sufficient to steer the angular position of the main-lobe ("beam steering"). In a number of applications, it is also desirable to control the beam width of the main lobe ("beamwidth variation").

The beam of an antenna array can be steered by only tuning the signal phase of all radiating elements. If the radiating elements are equidistant, the angular position of the main-lobe is shifted by successively increasing or decreasing the signal phase of one radiating element to the next. If all elements have equal signal phase the beam position is perpendicular to the antenna panel. This is called the "bore-sight" beam. To steer the beam by an angle $\alpha$ from its bore-sight position, the successive phase increase from element to element $\Delta\phi$ is given by:

$$\Delta\phi=2\pi\cdot(l/\lambda)\cdot\sin(\alpha) \tag{1}$$

Here, l is the element spacing and $\lambda$ the free-space wavelength of the transmitted or received signal.

A beam-width variation is obtained by dividing the array into two halves ("sub-arrays") and to steer the beam of each sub-array in an opposite direction. The signal phase thus successively increases, or decreases, from the middle of the total array to both ends. This procedure widens up the beam, if applied in a sufficient amount. It also leads to ripples in the main lobe. In most applications, however, these ripples are of no concern and this procedure is therefore satisfactory. Both procedures, beam steering and beam-width variation, can easily be overlaid.

The implementation of beam-steering and beam-width variation into an antenna array depends on the particular type of feed network used. There are two principally different types of feed networks: the corporate feed network and the series feed network.

For a corporate feed network, the aforementioned beam-shaping capabilities require a separate phase-shifter in each branch that leads to a radiating element. Since beam steering requires a successive increase of phase-shift from element to element, the tuning range per phase-shifter grows with the amount of array elements. For an n-element array, a maximum tuning range of $(n-1)\cdot\Delta\phi$, or at least 360 deg, is required for the last element. For most applications, this is impracticably large.

For a series feed network, the phase-shifters can be implemented into the main branch of the network. The signal going to the $n^{th}$ element, therefore, passes (n−1) phase-shifters. This has the advantage that each phase-shifter has to have a tuning range of $\Delta\phi$ only. Therefore, all phase-shifters can have the same design.

In such a series feed network, the phase-shifters are connected to the signal side branches via additional transmission-line sections with a corresponding electrical length $\beta$. This additional phase $\beta$ also adds up successively from element to element. In most cases, the feed network is laid out such that $\beta$ becomes multiples of $2\pi$, and $\beta$ is therefore of no relevance. If $\beta$ is different from multiples of $2\pi$, fine adjustment can be accomplished in the side branches that lead to the antenna elements.

One problem of series feed networks is that the beam position is frequency dependent. Reason for this is that the inter-element signal phase, $\beta+\Delta\phi$, clue to phase-shifter ($\Delta\phi$) and bare signal line ($\beta$), grows proportional with the signal frequency. Therefore, changing the signal frequency has the same effect as steering the beam by altering $\Delta\phi$. This limits the bandwidth of a series feed, given by the maximum tolerable variation of the beam position from its target value. In a 5-element array with a spacing of $0.7\lambda$, for instance, a frequency change of 6% leads to a beam tilt of 5 degrees.

This problem can be eliminated, when a series feed network is fed in the center of the array. Beam steering requires phase increase per phase-shifter in one half array and phase decrease in the other half array. A frequency variation df now leads to phase increase or decrease of $\beta+\Delta\phi$ in both sub-arrays, i.e. a beam steering of both sub-arrays in opposite direction. This does not affect the beam position since both tilting effects cancel each other out. Therefore, the frequency response of the array is much better.

Phase-tunable series networks seem to offer the appropriate solution for implementation of beam-steering and beam-width alteration capabilities into an antenna array. However, the realization has inherent drawbacks that can make this solution completely unattractive. Specifically, the limited performance of particular network circuits are highly enhanced due to their periodic reoccurrence in the array and when they are spaced such that a resonant condition exists. In a fixed series network, this resonant condition can be avoided by choosing the right phase between the repeated circuits in question. In an adjustable series network, the inter-element phase-tuning requirement makes this resonant condition inevitable since the inter-element phase is subject to changes over a wide range.

Furthermore, the most problematic network circuit is the phase-shifter itself, since it is difficult to match it sufficiently over a wide tuning range. FIGS. 1*a* and 1*d*, respectively, show an example of a 5-element tunable series feed and its performance degradation due to the implemented phase-shifters. The phase-shifter return-loss has been set to −21 dB (2 GHz), which is considered a good match (an equivalent circuit is presented in FIG. 1*b*). The return loss of the array, however, is 10 dB worse for particular phase-shifter positions due to the inevitable resonance condition and is therefore unacceptable.

In order to design a phase-tunable feed network that allows antenna-beam steering and beam-width variation with sufficient performance at adequate costs, a principal design has to be found without the drawbacks of the prior art.

SUMMARY OF THE INVENTION

The present invention is a device that provides a phase-tunable antenna feed network which allows beam-steering and beam-width variation with simple actuation, at low cost, and with high rf performance. The device provides a series-feed on which signal power splitters and phase-shifters are alternately disposed in series. Each phase-shifter consists of reflection-mode phase-shifter elements that operate in conjunction with an isolation device. This avoids the critical resonance condition between periodically aligned phase-shifters over the entire tuning range, since the isolation devices can easily be matched and/or aligned with non-resonant spacing. The main feed-line interconnections have the same impedance, thereby enabling the utilization of the same phase-shifter design for the entire phase-tunable antenna feed network. Moreover, a common driving mechanism can be used for the phase-shifters to steer the antenna beam. Splitting the array into two sub-arrays with individual collective driving mechanism further allows beam-width variation by steering the beams of both sub-arrays in opposite direction. The device of the present invention is further compatible with symmetrical series network designs that have better frequency response.

In an exemplary embodiment of the present invention, a series feed network utilizes a phase-shifter for shifting a signal propagating through a transmission line by moving a conductive construct between an active line and a ground plane of the transmission line. The conductive construct capacitively couples with either the active line and/or the ground plane, forming a capacitive shunt that reflects a significant part of the signal. The remaining portion of the signal is reflected at a terminated end of the transmission line, resulting in substantially no signal loss. This exemplary embodiment of the present invention provides compliance with high power levels, high linearity, and low insertion loss. Importantly, fabrication is inexpensive due to the use of commonly available materials. High electrical and mechanical stability is inherent to provide protection against temperature cycling, moisture, and corrosion.

Advantageously, all these features make the present invention attractive for implementation into flat panel antennas, especially as a low-cost solution that is compliant with high power levels. Importantly, high rf-performance and simple collective driving mechanisms are possible with the present invention. Large beam-steering range and beam-width variation can be achieved for a given phase-shifter tuning range. The device of the present invention is a flexible yet powerful solution for providing a phase-tunable antenna network with beam steering and beamwidth variation capabilities.

BRIEF DESCRIPTION OF THE DRAWINGS

A more complete understanding of the present invention may be obtained from consideration of the following description in conjunction with the drawings in which.

DETAILED DESCRIPTION

The following description is presented to enable a person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and the scope of the invention. Thus, the present invention is not intended to be limited to the embodiments disclosed, but is to be accorded the widest scope consistent with the principles and features disclosed herein.

Figure 1A:
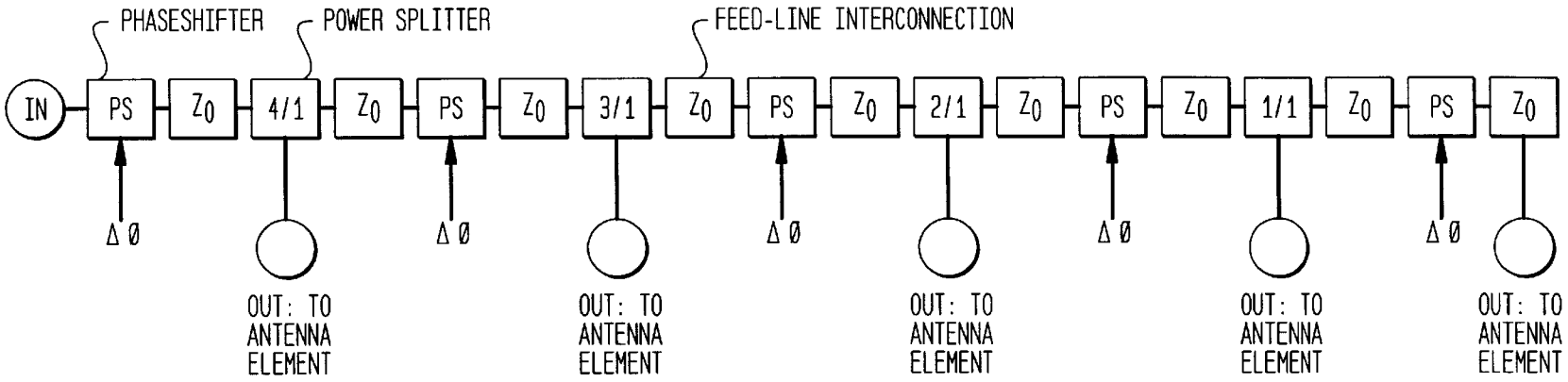
FIG. 1A (PRIOR ART)
FIG. 1*a* depicts a phase-tunable antenna series feed network for 5 antenna elements.
Figure 1B:
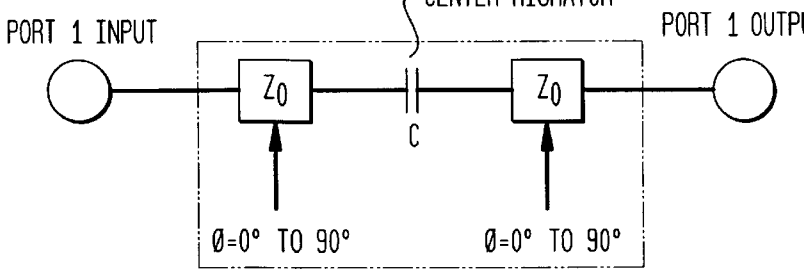
FIG. 1B (PRIOR ART)
FIG. 1*b* depicts the equivalent circuit of a phase-shifter with one reflection point at the center represented by a series capacitance, where the phase-shifter is operated in transmission-mode.
Figure 1C:
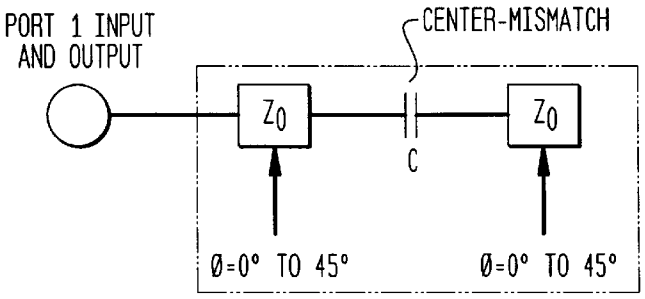
FIG. 1C (PRIOR ART)
FIG. 1*c* depicts the equivalent circuit of a phase-shifter with one reflection point at the center represented by a series capacitance, where the phase-shifter is operated in reflection-mode.

FIG. 1*a* shows a typical example of an antenna series network with 5 phase-shifters driving 5 antenna elements. Such an array could be for instance a sub-array of a symmetrically fed 10- or 11-element array. The resulting antenna beam of such an array will have the highest possible gain, if the phase between successive outputs is the same. This advantageously occurs when all the phase-shifters are at the same position. To steer the antenna beam from this point, all phase-shifters have then to be moved in the same direction and by the same amount. FIG. 1*b* illustrates the equivalent circuit of a phase-shifter operated in transmission mode. FIG. 1*c* illustrates the equivalent circuit of a phase-shifter operated in reflective mode.

Typically, phase-shifters used for such a symmetrical array are transmission-mode phase-shifters. They consist of a transmission line with two ports for signal input and signal output, whereby the total phase of a signal propagating from input to output is changed by either altering the propagation velocity of the line or its length. These commonly known techniques have the downside that they cannot be realized in absolute perfection, i.e. all these devices have a non-zero return loss. Phase shifting by altering the propagation velocity of the transmission line, for instance, is accomplished by changing the permitivity or permeability of the transmission line medium. This also affects the line impedance and therefore introduces at least one reflection point. Line-stretcher phase-shifters, based on the extension of a coaxial line in a telescope-like fashion, require one or more sliding contacts which are subject to manufacturing tolerances, aging, corrosion, etc. and can therefore introduce a mismatch.

For a single phase-shifter device, this imperfection is usually tolerable. Implemented into a series feed network, however, the overall performance is deteriorated to a much higher degree. One reason being that the series alignment with equal interval phase can create a periodic resonance condition between the mismatch points of the phase-shifters, which enhances the total return loss of the array significantly. When the phase-shifter positions are off-resonance, a required beam tilt demands insertion or depletion between these mismatch-points, which in turn drives the array into a resonance condition. This means that the array can be matched for only particular phase-shifter positions but not over a wide steering range.

Figure 1D:
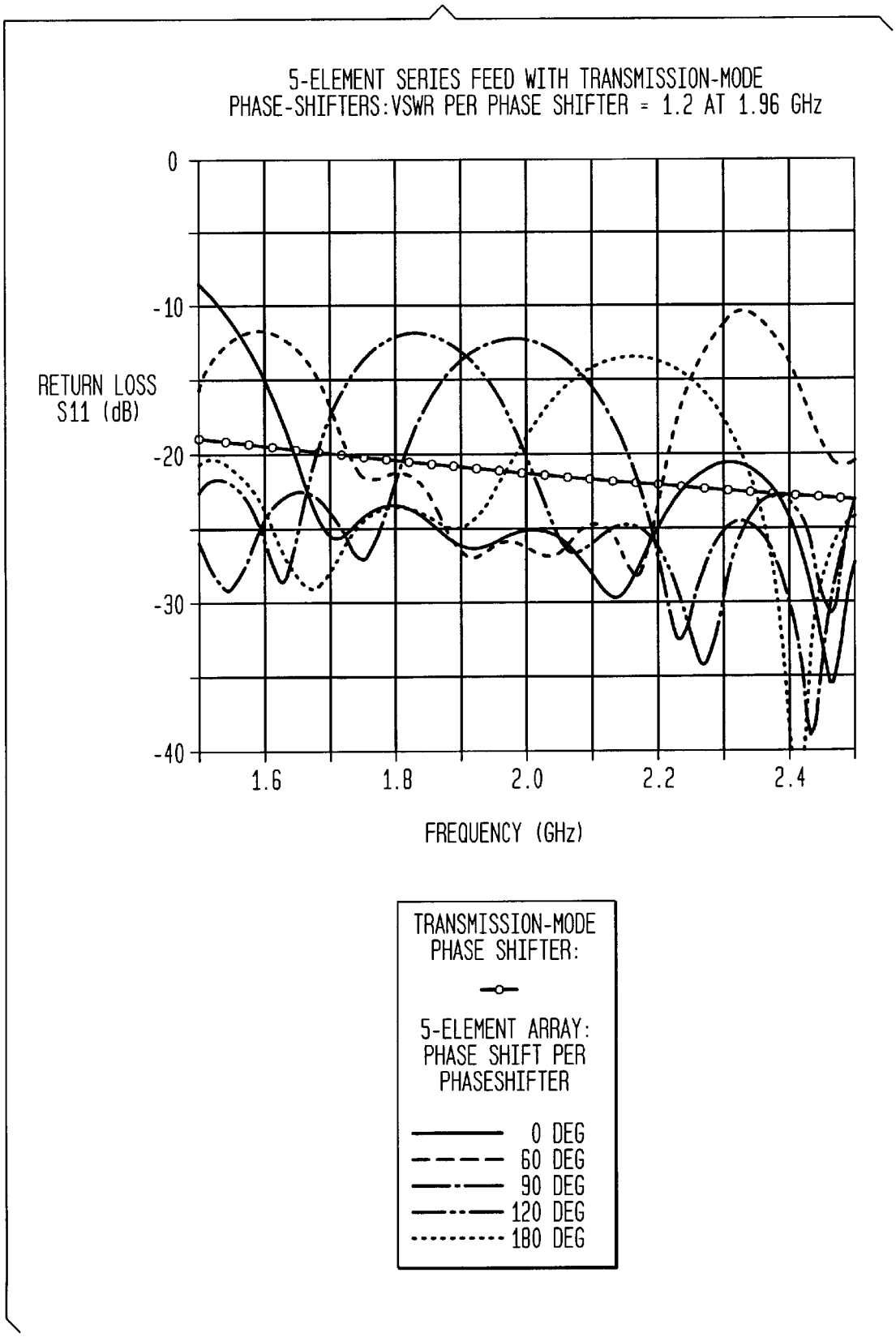
FIG. 1D (PRIOR ART)
FIG. 1*d* depicts the return-loss of a single phase-shifter (FIG. 1*b*) and the series feed network in FIG. 1*a*.

The performance of such a prior art array (see FIG. 1*a*) was simulated with transmission-mode phase-shifters that have one center impedance mismatch (FIG. 1*b*). This center impedance mismatch was simulated by adding a series capacitance in between two transmission-line sections with variable electrical length. Such a situation would be typical for a line-stretcher phase-shifter with a slightly imperfect sliding contact. FIG. 1*d* shows the return loss of this phase-shifter and of the 5-element array. While the phase-shifter shows excellent performance with a return loss of only S11=−21 dB at 2 GHz (VSWR=1.2), the array reaches values for return loss close to −11 dB, which is unacceptable in most applications. In order to avoid such an array degradation, the phase-shifter performance has to be improved significantly. This, in many cases, is technically not realizable or too expensive.

Figure 2A:
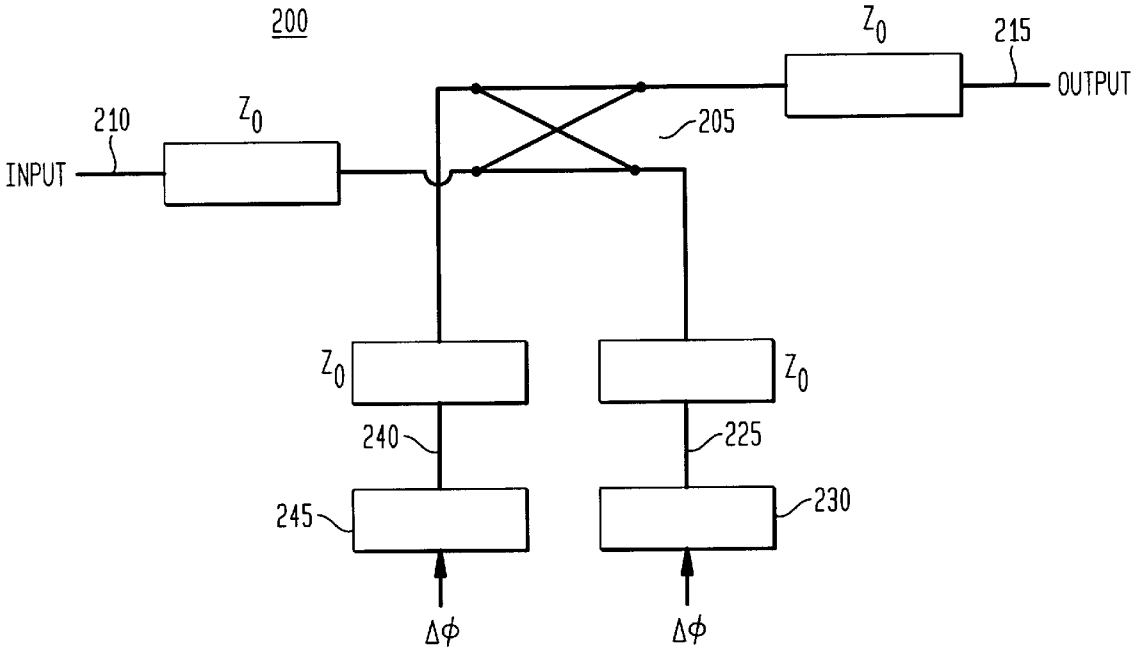
FIG. 2*a* depicts an exemplary phase-shifter operating with 2 reflection-mode phase-shifter elements and a 3 dB-backward-coupler circuit.
Figure 2B:
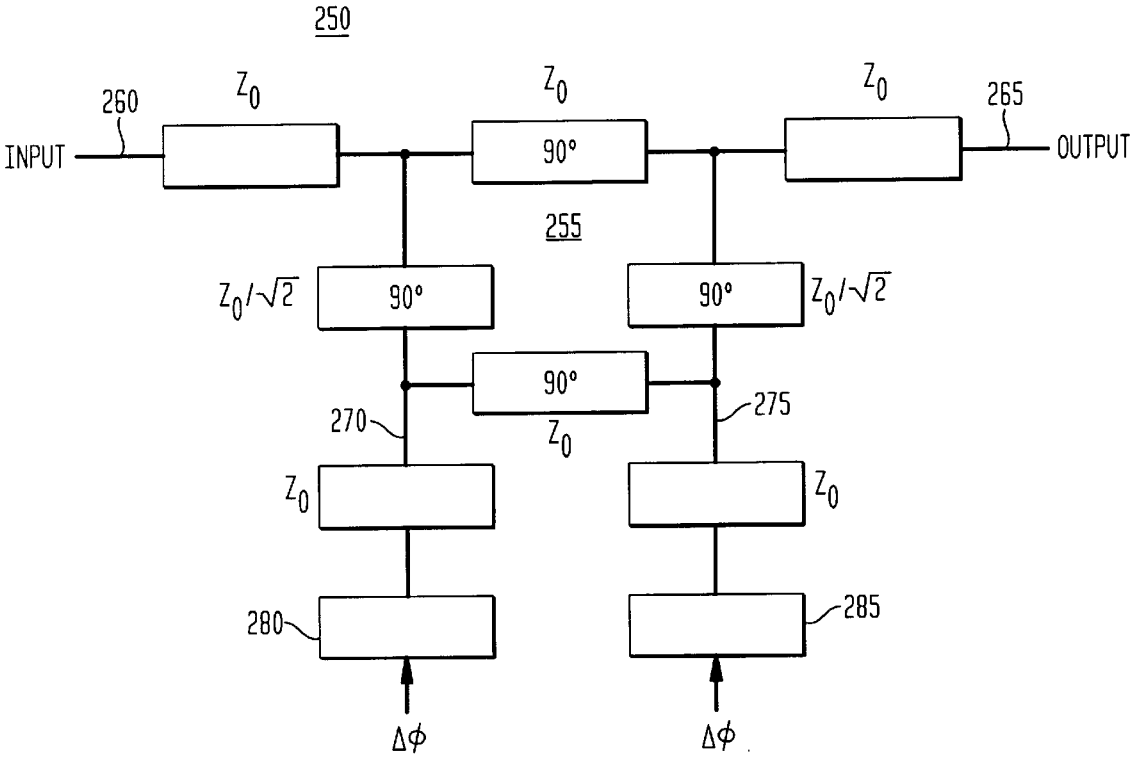
FIG. 2*b* depicts an exemplary reflection-mode phase-shifter operating with 2 reflection-mode phase-shifter elements and a quadrature-hybrid circuit.

The design of the present invention allows excellent array performance while utilizing standard, cheap phase-shifting techniques. For this invention, a phase-shifter design is utilized that consists of reflection-mode phase-shifter elements connected to an isolation device. The elements have only one port for in-going and reflected, i.e. phase-shifted, signals. The isolation device serves to separate both components. The device can be laid out as a 3 dB-backward coupler as shown in FIG. 2*a*, a quadrature hybrid as shown in FIG. 2*b*, a circulator, or any other device that can provide the same function. If implemented with a circulator, only one phase-shifter element is required, otherwise two phase-shifter elements are needed to provide the same phase shift.

Referring to FIG. 2*a*, a device 200 uses two reflection-mode phase-shifters with one backward coupler. A 3-dB backward coupler 205 is shown as a 4-port device. In the figure, two ports of 3-dB backward coupler 205 are used for the input signal and the output signal. These are noted as 210 and 215. The impedance at both ports is equal to the impedance of the interconnection sections, $Z_0$. The other two ports, 225 and 240, are connected to reflection-mode phase shifters 245 and 230, respectively. To guarantee proper performance, both reflection-mode phase-shifters 230 and 245 have to be operated in unison. The phase that they are set to should ideally be the same.

In FIG. 2*b*, a device 250 employs two reflection-mode phase-shifters with a quadrature hybrid (QHD). A QHD 255 is shown as a 4-port device. In the figure, two ports of QHD 255 are used for the input signal and the output signal. These are noted as 260 and 265 for QHD 255. The impedance at both ports is equal to the impedance of the interconnection sections, $Z_0$. The other ports 270, 275 are connected to reflection-mode phase-shifters 280, 285, respectively. Therefore, two reflection-mode phase-shifters are needed in conjunction with a QHD. To guarantee proper performance, both single-port phase-shifters have to be operated in unison. Again, the phase that they are set to should ideally be the same.

As illustrated, since each phase-shifter element in the array operates in reflection-mode, return loss and output signal add coherently, and no signal power gets lost. Therefore, very simple and cheap phase-shifting methods can be applied. Any mismatch internally or at the port of the reflection-mode phase-shifter element only reduces the phase shifting range, which is usually of no concern.

In conjunction with the isolation device, the phase-shifter becomes a 2-port device and therefore prone to return loss. This return loss, however, is entirely due to the imperfection of the isolation device. Since the isolation device has a principally simple design that remains fixed for all phase-shifter positions, it can easily be fine-tuned and optimized in initial design stages without increasing production costs. A remaining mismatch of this isolation device can further be minimized by non-resonant spacing in the array. This non-resonant spacing will not be affected by the position of the phase-shifters, since they do not change the phase between the isolation devices. Therefore, excellent array performance can be accomplished by using low-cost reflection-mode phase-shifter elements in conjunction with isolation devices in non-resonant spacing within the array.

Figure 3:
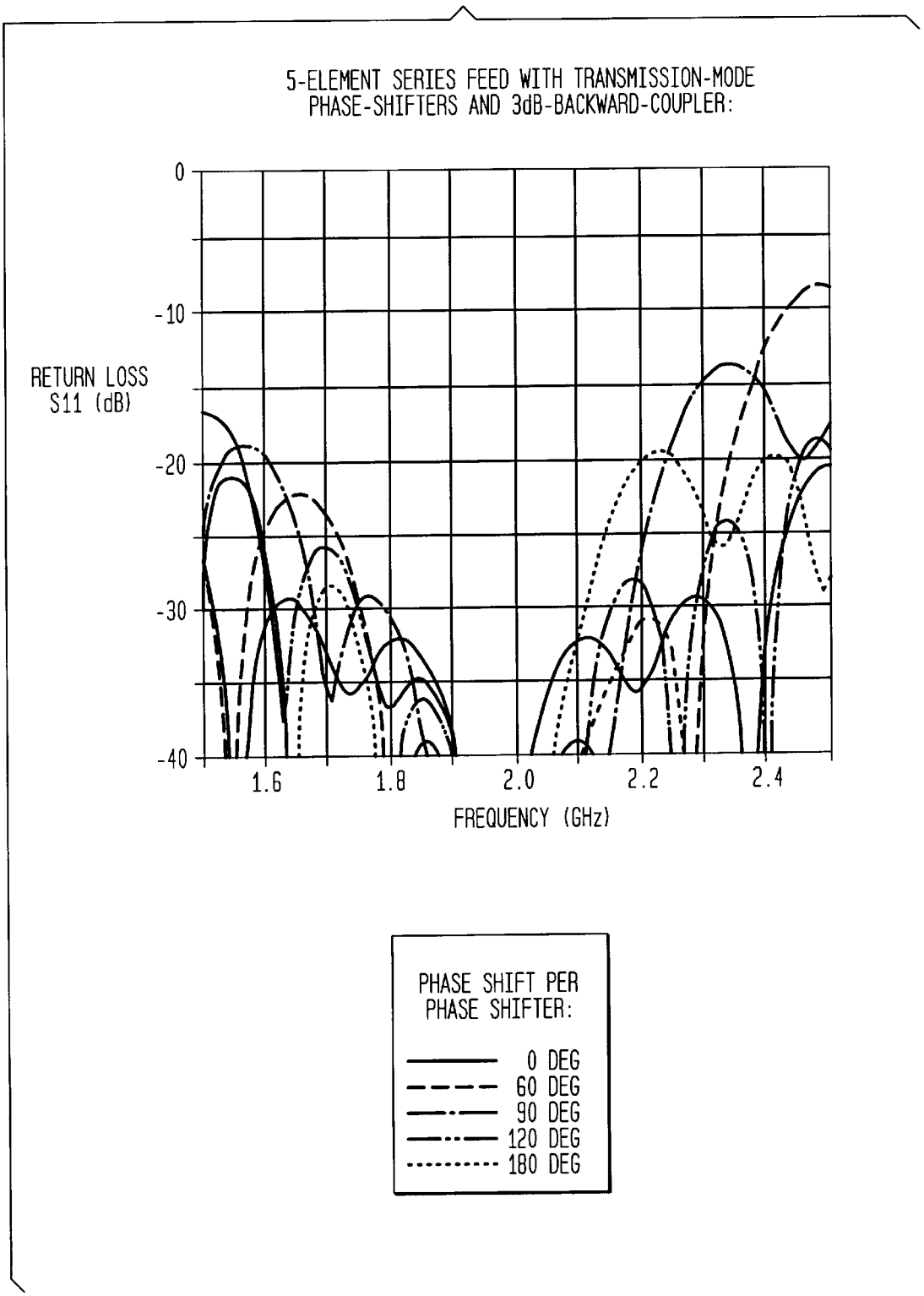
FIG. 3 depicts the return loss of the series feed of FIG. 1*a* utilizing the exemplary configuration of reflection-mode phase-shifter elements in conjunction with a perfectly matched 3 dB-coupler device.

For example, FIG. 3 shows the performance of a 5-element-array (similar to FIG. 1*a*) with phase-shifters based on the 2 reflection-mode phase-shifter elements and 3 dB-backward coupler configuration shown in FIG. 2*a*. For this simulation, the imperfect phase-shifter of FIG. 1*c* was used for each reflection-mode phase-shifter element. The array-simulation shows very low return loss (S11<−20 dB) over a wide bandwidth (30%).

Figure 4A:
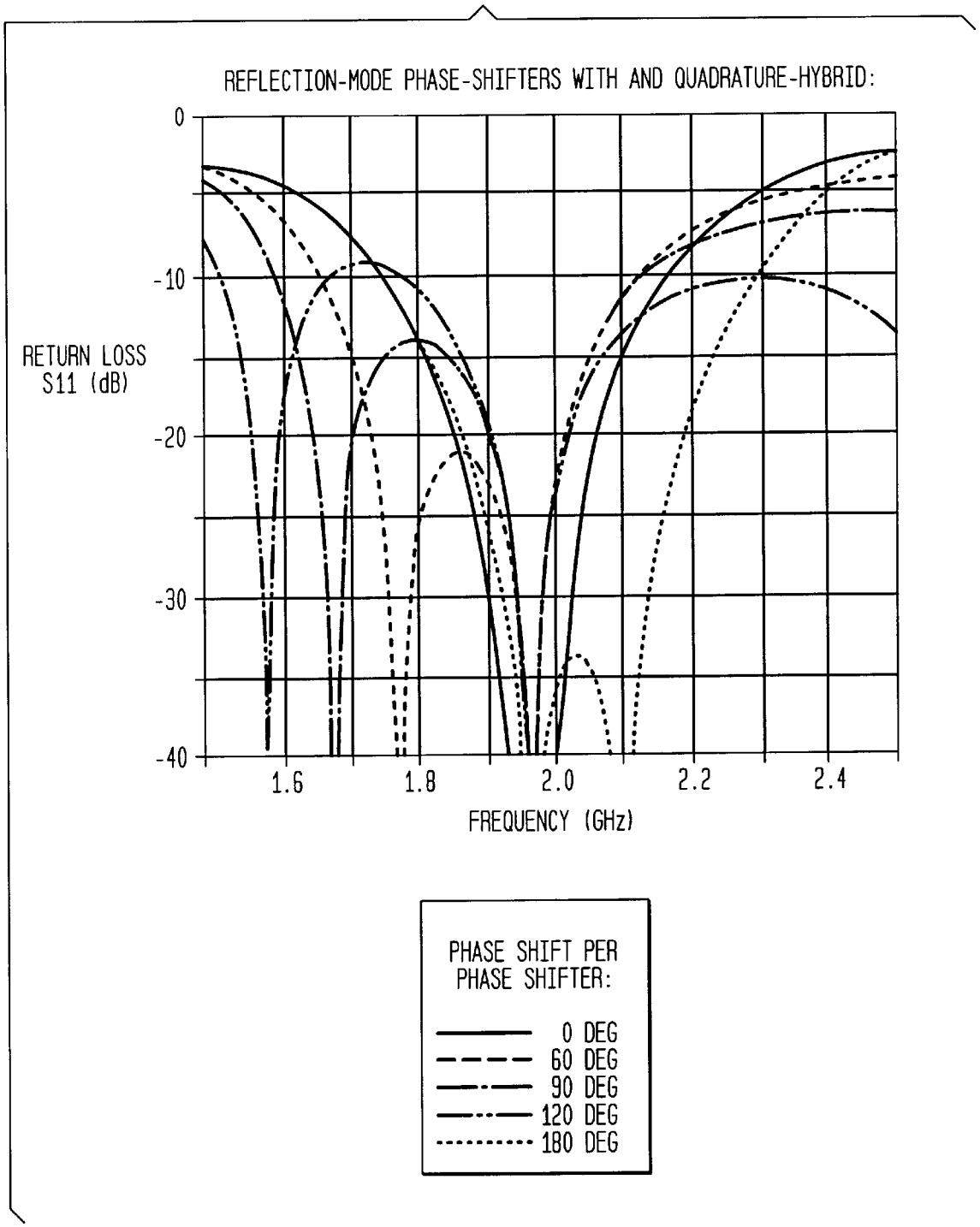
FIG. 4*a* depicts the return loss of an exemplary phase-shifter utilizing any type of reflection-mode phase-shifter elements in conjunction with a perfectly matched quadrature-hybrid device.
Figure 4B:
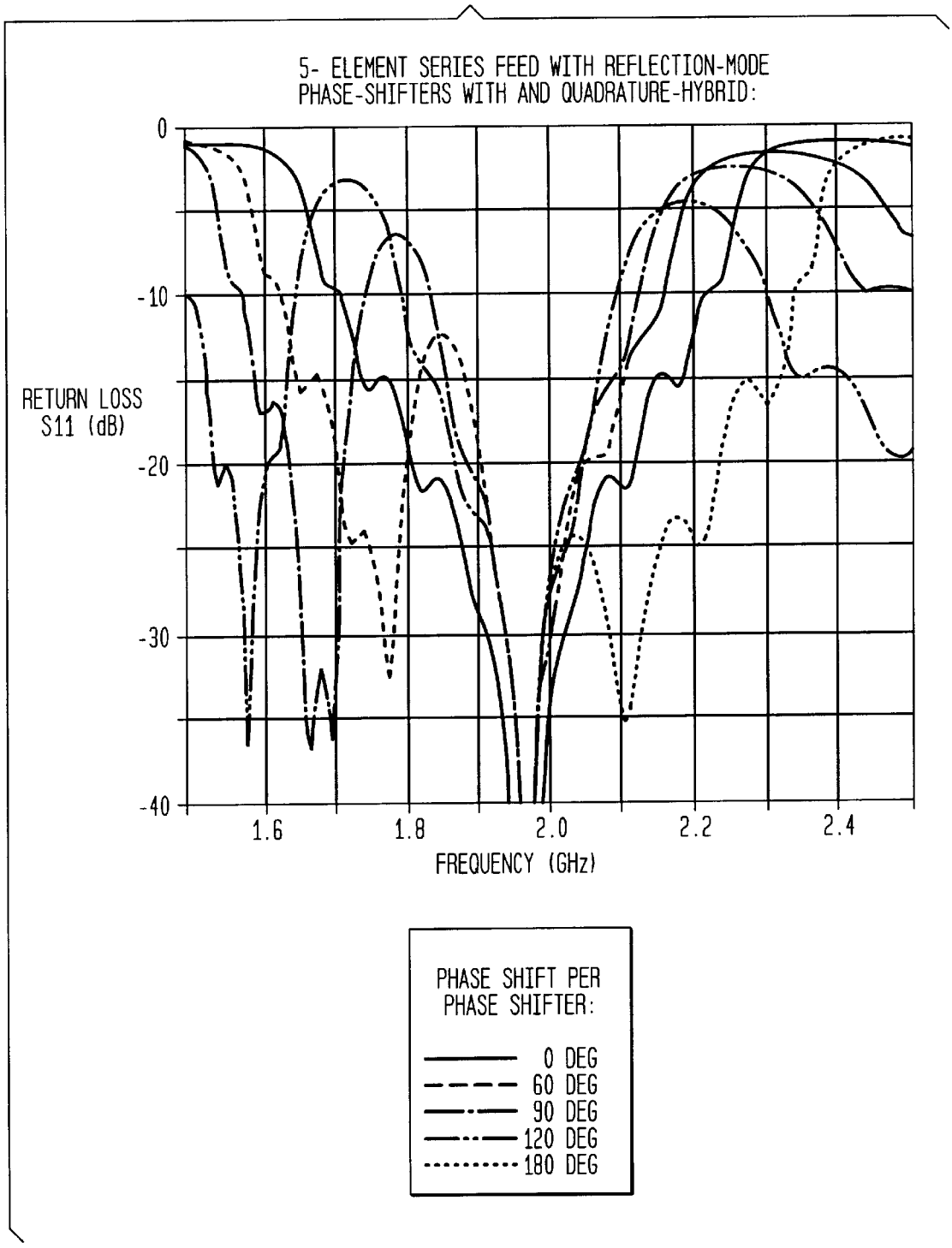
FIG. 4*b* depicts the return loss of the series feed of FIG. 1*a* utilizing the exemplary configuration of reflection-mode phase-shifter elements in conjunction with a perfectly matched quadrature-hybrid device and where the quadrature hybrids are aligned out-of-resonance.

If a quadrature hybrid is chosen instead of the 3dB-backward coupler, each phase-shifter has less bandwidth due to the nature of the quadrature hybrid. FIG. 4*a* shows the return loss of such one phase-shifter device. The bandwidth, measured by S11 <20 dB, is only 5%. For most applications, however, this bandwidth is large enough. To avoid further bandwidth reduction in the array, the QHDs have to be placed off-resonance, i.e. the inter-QHD-phase has to be 90°+(n* 180°). In this case, the array bandwidth (as shown in FIG. 4*b*) becomes the same as that of a single QHD-phase-shifter. This proves that the imperfect performance of any isolation device will not result in degraded array performance when non-resonant spacing is chosen.

Given the realization of a series feed network with adequate performance, further advantages inherent to series feeds can be implemented. For example, beam steering requires that all phase-shifters be set to the same phase. This allows use of a collective actuation of all phase-shifters. For voltage controlled phase-shifters, for instance, only one voltage has to be supplied to all of the phase-shifters. If mechanically driven phase-shifters are used, they can be driven collectively via a rigid connection. This saves cost and logistical overhead for the beam steering as necessary for a corporate feed network. If beam-width variation is also required, the array can be split into two sub-arrays, and one common actuator can drive all phase-shifters in each sub-array.

Figure 5A:
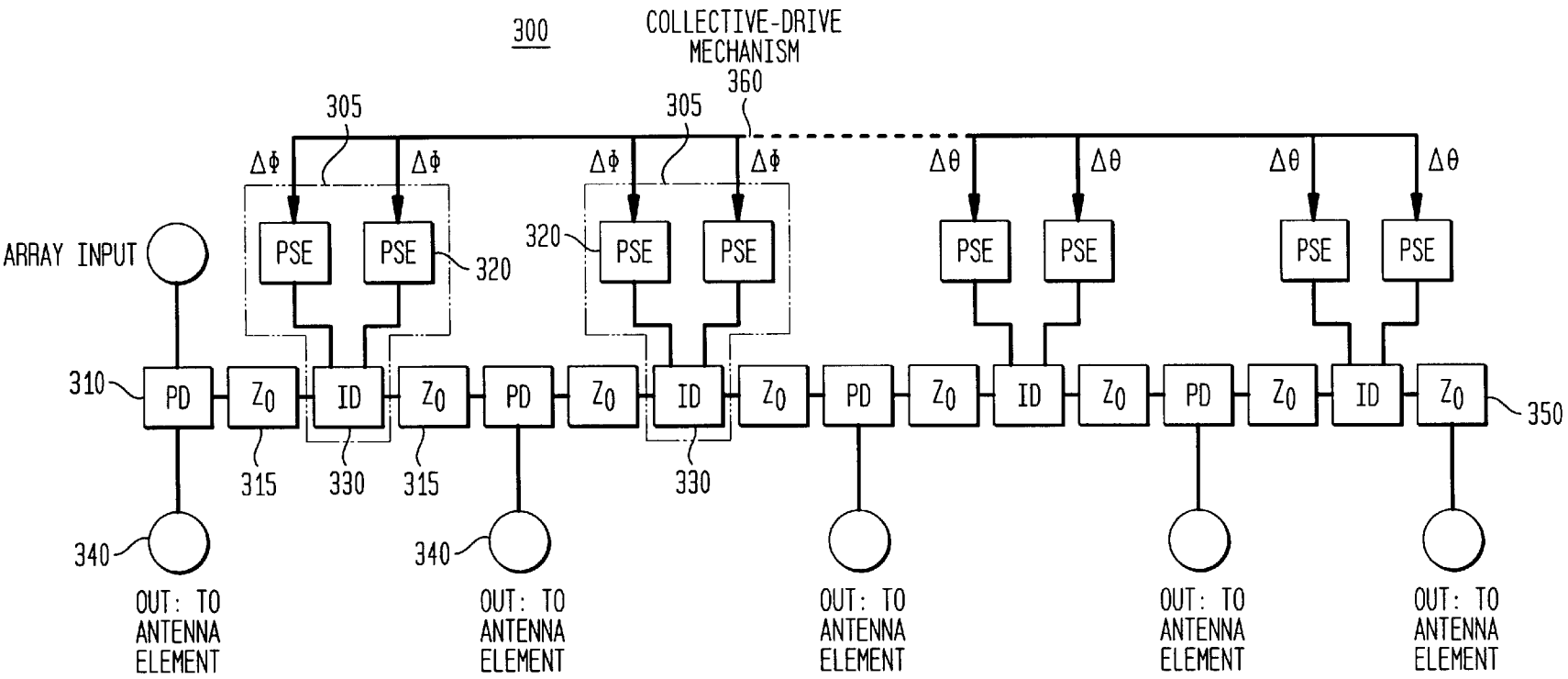
FIG. 5*a* depicts an exemplary series feed utilizing 2 collective driving mechanisms for all phase-shifters for beam steering and beam-width variation.

Specifically, referring to FIG. 5*a*, a series feed for a 5-element array 300 is shown. Array 300 includes phase-shifters 305 and power dividers 310 disposed alternately in series, being connected by interconnection sections 315. Phase-shifters 305 further include reflection-mode phase-shifter elements 320 that are coupled to isolation devices 330. An input signal is supplied to a power divider 310, which in turn delivers an output signal to an antenna element 340 and to a main feed line 350. A collective drive mechanism 360 is coupled to each of the reflection-mode phase-shifter elements 320. If only beam steering is required, all reflection-mode phase-shifter elements 320 can be driven collectively. If beam-width variation is also desirable, reflection-mode phase-shifter elements 320 can be divided into a lower sub-array and an upper sub-array and each sub-array can be driven independently.

Figure 5B:
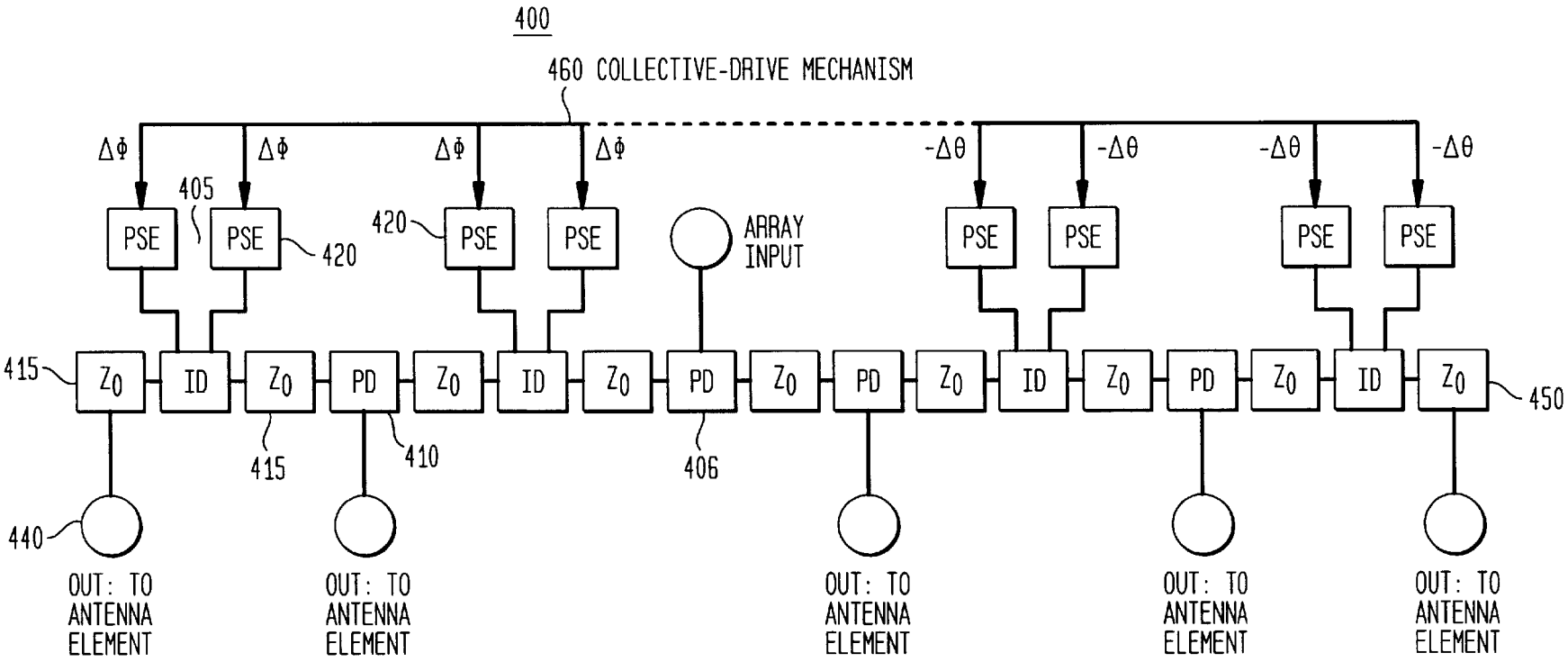
FIG. 5*b* depicts an exemplary symmetrical series feed utilizing 2 individual collective driving mechanism for all phase-shifters in each sub-array for the purpose of beam steering and beam-width variation.

Referring now to FIG. 5*b*, there is shown a series feed for a symmetrical 5-element array 400. Array 400 includes phase-shifters 405 and power dividers 410 disposed alternately in series, being connected by interconnection sections 415. Phase-shifters further include reflection-mode phase-shifter elements 420 that are coupled to isolation devices 430. In this embodiment, an input signal is supplied to a central power divider 406, which in turn delivers an output signal to a reflection-mode phase-shifter 405 (specifically isolation device 430) and to another power divider 410. For beam-steering array 400, upper and lower sub-arrays have to be driven in opposite directions. For many designs, this can still be accomplished with a single collective driving mechanism 460 as detailed below.

The device of the present invention is not restricted to any particular type of reflection-mode phase-shifter or isolation device. A preferred embodiment of the series feed implementation is based on a mechanically steered array with exceptional rf-performance, compliance with high power levels, high mechanical stability, and low manufacturing costs. This implementation can be realized with any air-suspended or partly air-suspended quasi-TEM transmission line. Advantageously, however, air-suspended stripline or coplanar waveguide structures are used.

A preferred embodiment of a reflection-mode phase-shifter element consists of a transmission-line section that is terminated by an open or a short, and one or more metallic or conductive constructs or "sledges". These sledges have no electrical contact to either an active line or ground. However, they form a capacitive shunt between the active line and ground, which results in reflection of a major part of the signal. The rest of the signal is reflected from the termination at the line end. The sledges can slide along the line, which moves their reflection plane and therefore the phase of the total reflected signal.

Figure 6A:
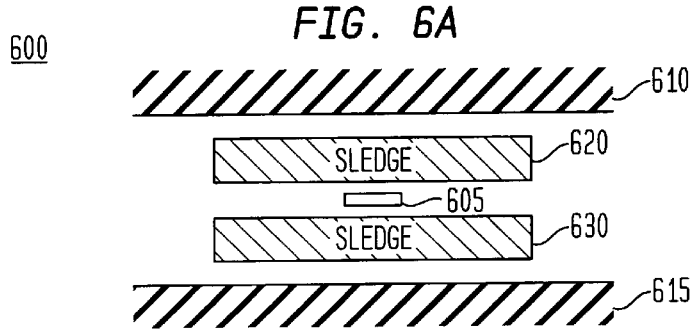
FIG. 6*a* depicts an end cross-sectional view of an exemplary embodiment of a reflection-mode phase-shifter element for air-suspended stripline structures.
Figure 6B:
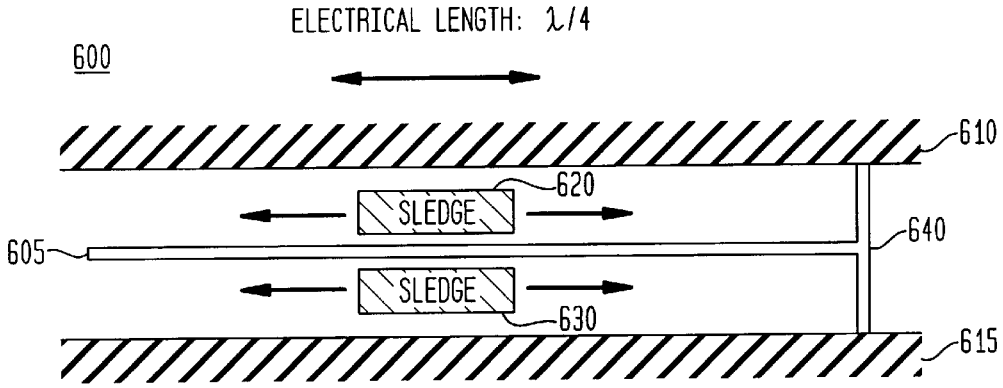
FIG. 6*b* is an side-cross sectional view of the phase-shifter shown in FIG. 6*a;*

Referring to FIGS. 6*a* and 6*b*, a reflection-mode phase-shifter 600 in accordance with the invention is illustrated in end and side cross-sectional views. Reflection-mode phase-shifter 600 includes an air-suspended active line 605 and ground planes 610 and 615. Sledges 620 and 630 are deployed between active line 605 and ground plane 610 and active line 605 and ground plane 615, respectively. Termination is implemented by an electrical short 640. In designs having an electrical open at the end of active line 605, sledges 620 and 630 can be shifted over the line end. The air-suspended stripline implementation has the added advantage that the sledges that are used can be designed to fill most of the air gap over a significant length of the line. The smaller the remaining air-gap, the larger the reflection at the sledges.

Figure 6C:
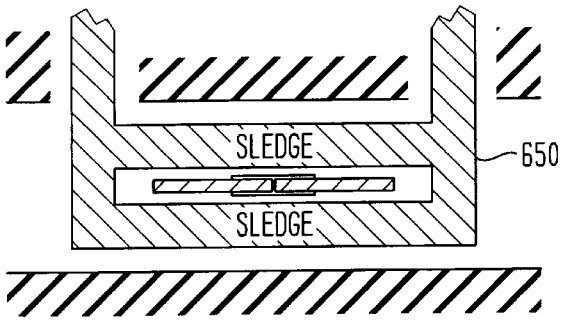
FIG. 6*c* depicts an exemplary implementation and mechanical driving of the reflection-mode phase-shifter element of FIG. 6*a*.

Implementation of a collective drive mechanism with respect to FIGS. 6*a* and 6*b* is shown in FIG. 6*c*. Referring to FIG. 6*c*, common rigid connection 650 is implementable through slots in one of the ground planes. Obviously, this mechanical feed-through is placed in sufficient distance from the active line. It may be advantageous to make this connection non-conductive, so as to avoid signal leakage since the sledges carry active signal. Advantageously, common rigid connection 650 can be used for driving the sledges and can be attached to a stepping motor for remote control.

Figure 6D:
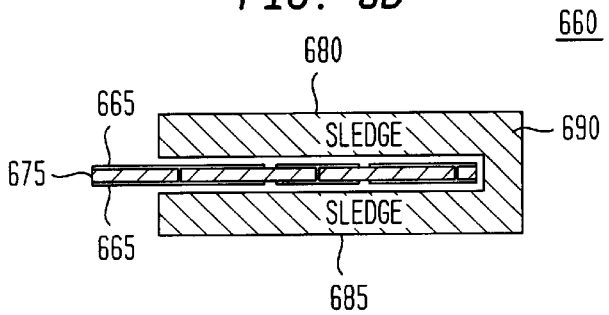
FIG. 6*d* depicts an exemplary embodiment of a reflection-mode phase-shifter element for symmetrical coplanar waveguide structures (cross section).

Another exemplary embodiment of a reflection-mode phase-shifter element is shown in FIG. 6*d*. A coplanar waveguide device 660 has grounds 665, board 675 and two sledges 680 and 685 coupled via common connection 690. For coplanar waveguide structures, the sledges can be thin metal plates that hover over the line. However, the impact of the capacitive shunt is typically smaller for coplanar waveguide structures than for air-suspended striplines since most of the electrical field lines of the coplanar waveguide mode are within the board.

The length and composition of the conductive constructs or sledges also influence overall performance. If the length of the sledges is about ¼ of the guided wave length, the reflection at both interfaces between air-suspended line and sledge-suspended line add coherently and the total signal reflection at the sledges is maximal. The sledges themselves are constructs of any materials that have sufficiently high conductance. Aluminum, for instance, is a perfect sledge material, that allows for easy machining, is light weight and has high conductance. As stated previously, the sledges slide between the ground plane and the circuit board. To avoid electrical contact with either ground or active line, the sledges can be coated with a thin layer of insulating material. Aluminum sledges, for instance, can be hard-coated (coating thickness of about 2 mils), resulting in a surface that is insulating, slightly lubricant, and mechanically stable against scratching. Since the dielectric constant of this coating is higher than 1, the capacitance $C_{tot}$ is further enhanced, increasing the tuning range.

As a result, the reflection-mode phase-shifter of the present invention has the following advantages: high power-handling capabilities, highly linear response with respect to the rf-field, low insertion loss due to air-suspended line techniques, high mechanical stability against corrosion and aging since no sliding contacts are used, small motion forces and low manufacturing cost. When implemented with the array of the present invention, it further permits simple integration into array-layouts and simple integration of a collective drive mechanism.

Figure 7:
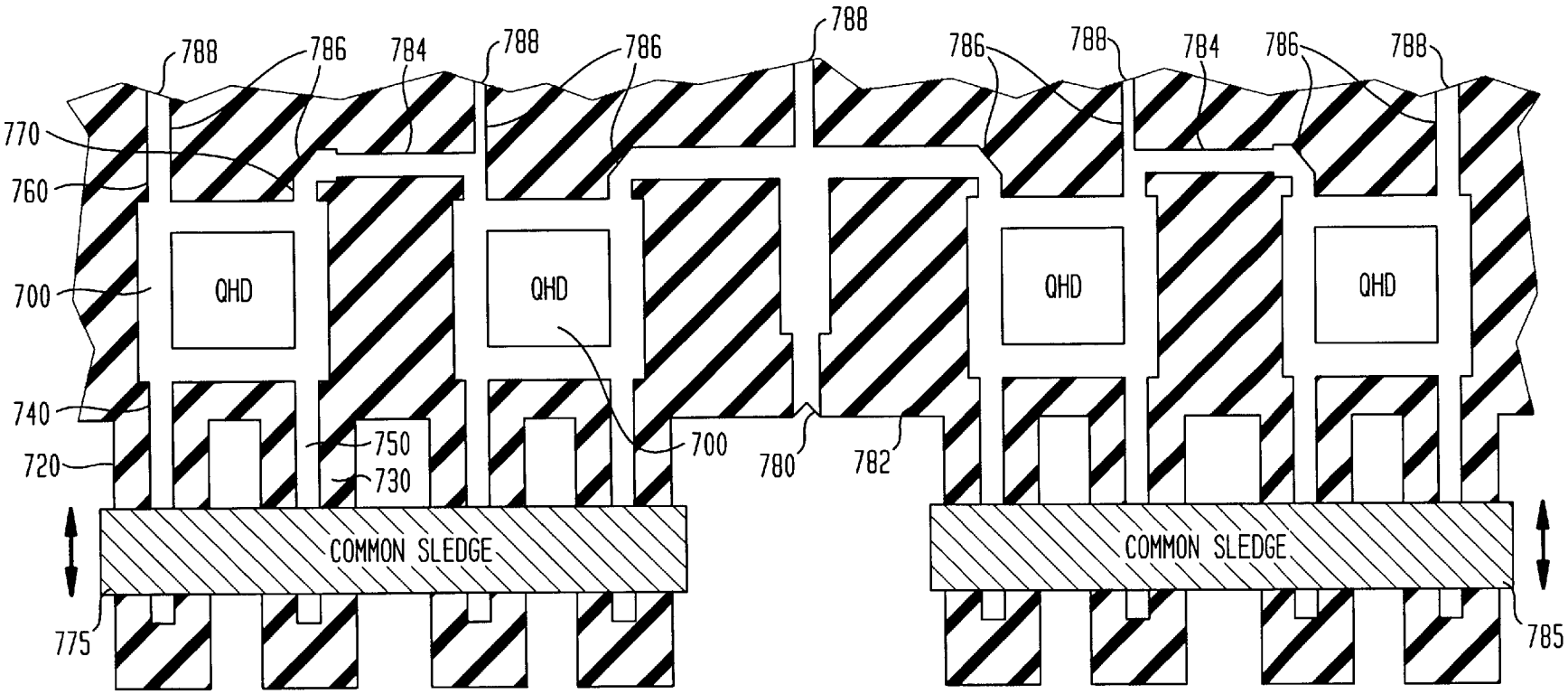
FIG. 7 depicts an exemplary phase-tunable antenna feed network incorporating a phase-shifter utilizing quadrature hybrids with one common-sledge driving mechanism for each sub-array.
Figure 9:
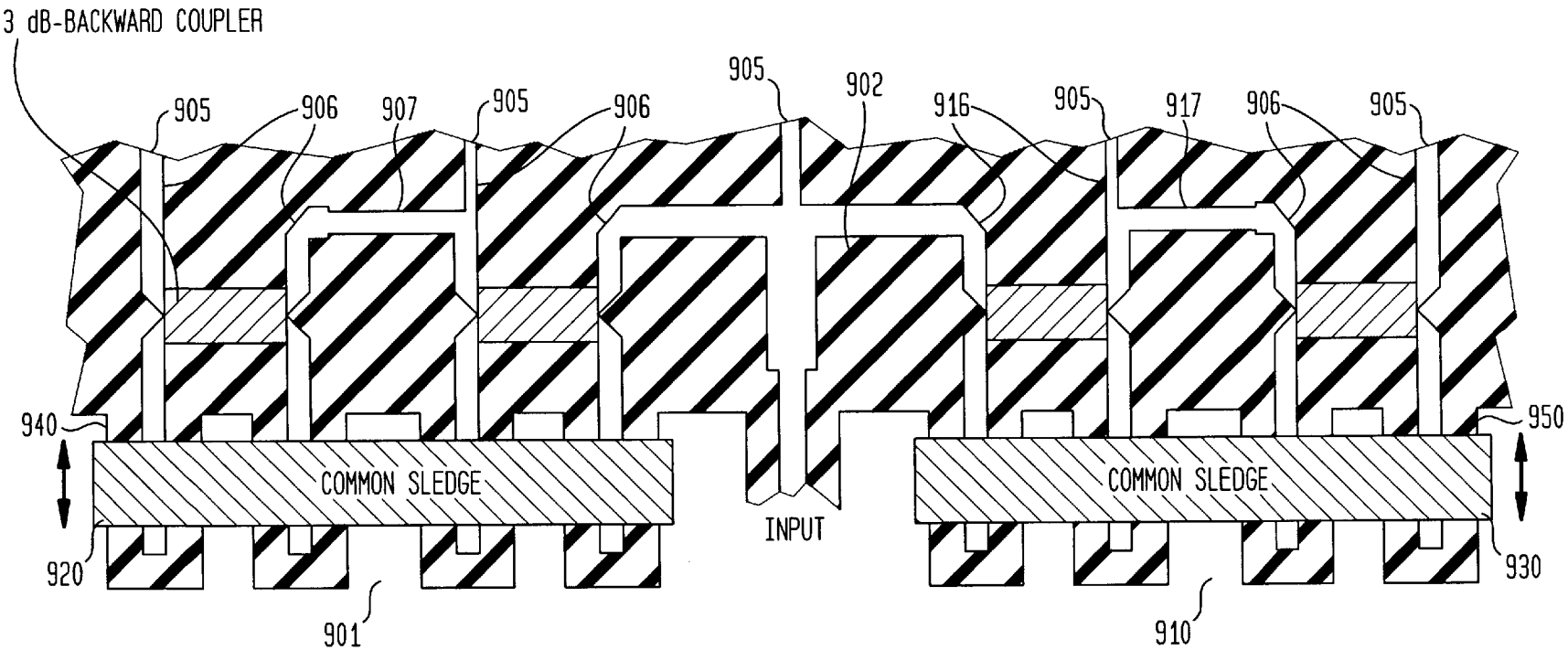
FIG. 9 depicts an exemplary phase-tunable antenna feed network incorporating a phase-shifter utilizing 3 dB-backward couplers with one common-sledge driving mechanism for each sub-array.
Figure 10:
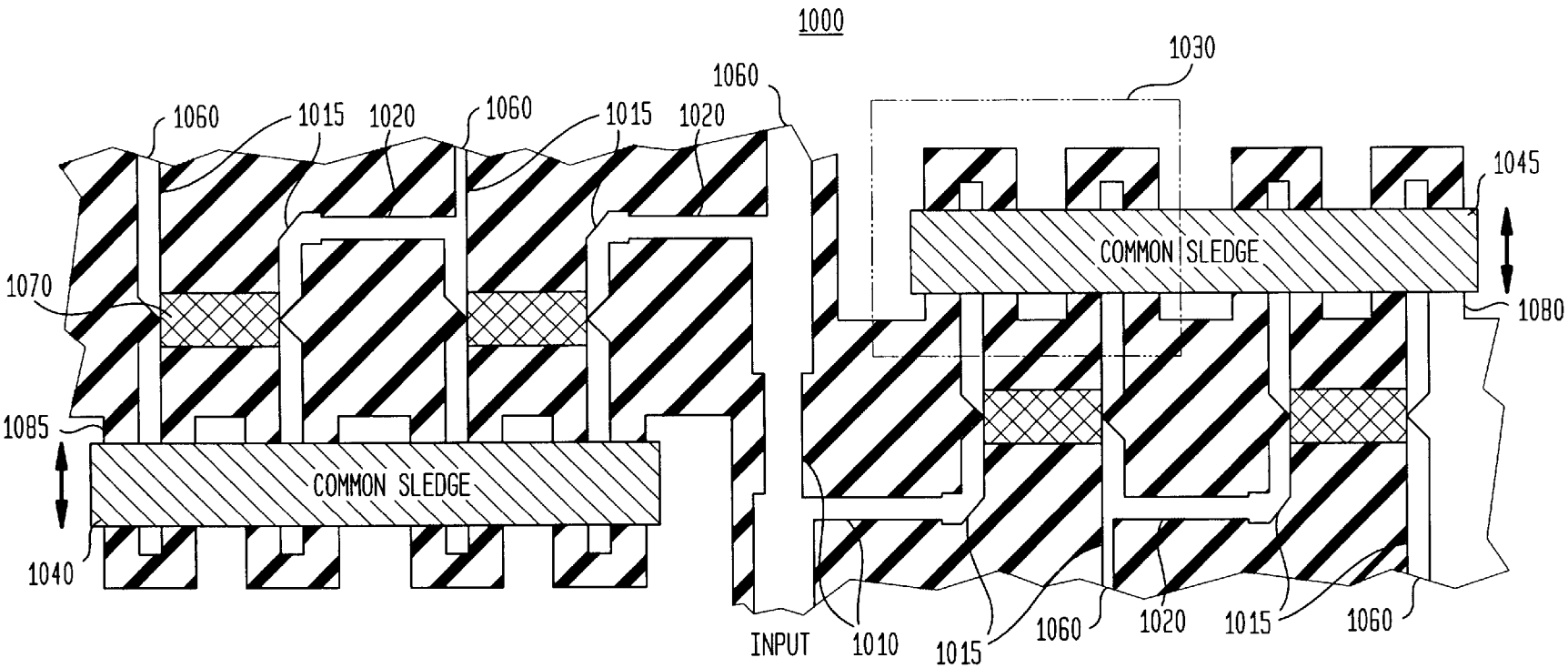
FIG. 10 depicts an exemplary phase-tunable antenna feed network incorporating a phase-shifter utilizing 3 dB-backward couplers with one common-sledge driving mechanism for the entire array.

The remaining description illustrates several embodiments of series arrays that utilize reflection-mode phase-shifters. They all are symmetrically fed 5-element arrays as shown in FIG. 5*b*. FIG. 7 shows an implementation based on QHDs, and FIG. 9 shows the same array with 3 db-backward couplers. In these arrays, reflection-mode phase-shifter elements, isolation-devices, power splitters, and impedance transformers are all embedded into the same layout. The entire structure is therefore very compact and inexpensive to manufacture. FIG. 8 shows the implementation of a collective mechanical driving mechanism for all reflection-mode phase-shifter elements in each sub-array. This can be realized either by one common sledge for the whole sub-array, or by several sledges that are rigidly connected. These two arrays allow beam steering and beam-width variation over a wide angular range. If only beam steering is required and therefore one single collective drive mechanism desirable, a layout can be chosen as depicted in FIG. 10. Here one sub-array is turned upside down, such that the sledge motion for beam steering is the same for both sub-arrays. The two common sledges can therefore be connected via a rigid link as shown in FIG. 8*b*.

Referring specifically to FIG. 7, an exemplary phase-tunable antenna feed network in a symmetric series configuration is illustrated. The input signal 780 is fed to a center signal power splitter 782 for feeding a first sub-array and a second sub-array. Here, reflection-mode phase-shifters 720 and 730 are used in conjunction with quadrature hybrids (QHDs) 700. The phase-shifters are alternately disposed with signal power splitters 784 (consisting of reactive T and 90° transformers), and coupled with interconnection sections 786. The signal is fed through the phase-shifter and signal power splitter ports 788 to radiating antenna elements (not shown). A common sledge structure 775 and 785 is used for each sub-array.

Figure 8A:
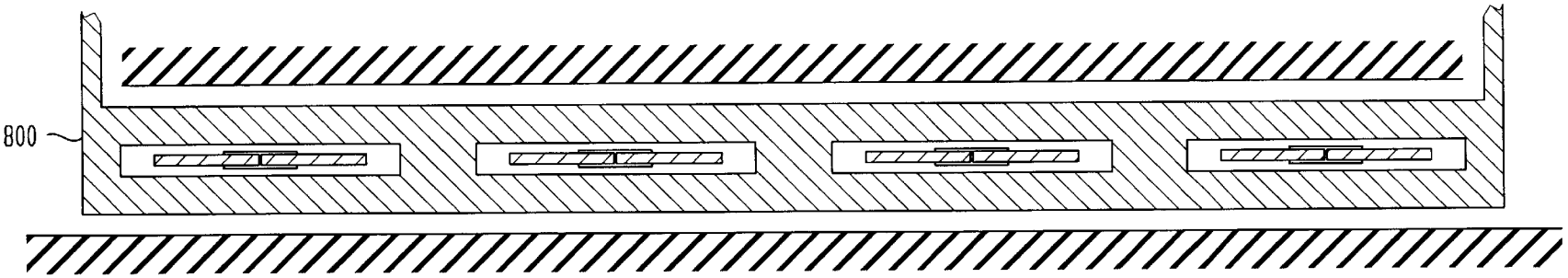
FIG. 8*a* depicts an exemplary single uniform sledge driving mechanism for each sub-array.
Figure 8B:
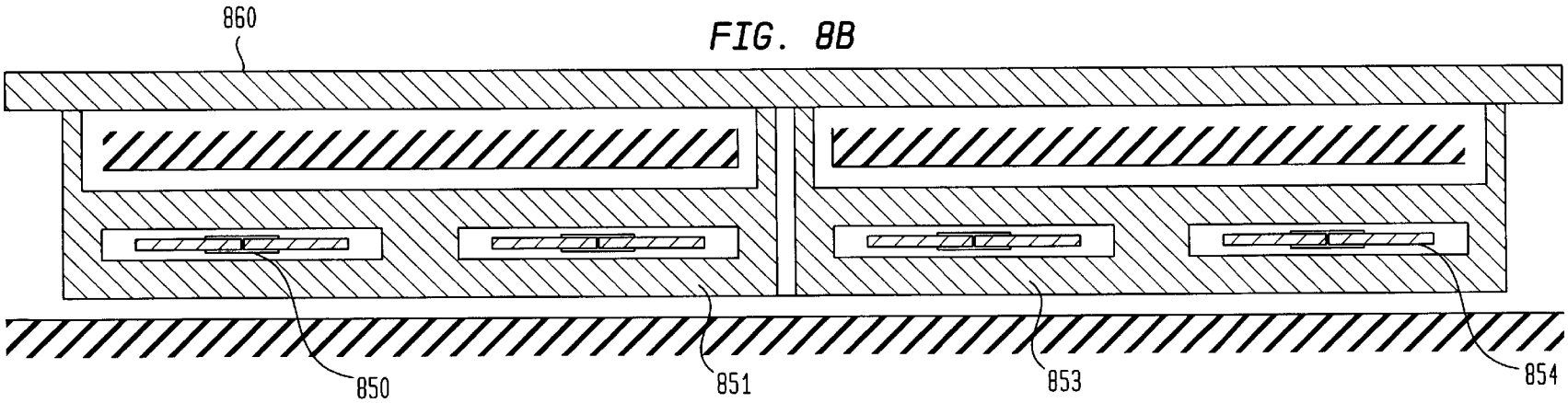
FIG. 8*b* depicts an exemplary phase-shifter driving mechanism with individual sledges that are rigidly coupled.

FIGS. 8*a* and 8*b* show two embodiments of the sledges as driving mechanisms for the phase-shifters. In FIG. 8*a*, a single uniform sledge 800 is used as the driving mechanism. In FIG. 8*b*, individual sledges 851, 853 are collectively driven by connecting the individual sledges with a rigid coupling mechanism 860. Again, this parallel alignment and collective drive mechanism relieves the mechanical requirements since only two common sledges have to be moved independently. If beam steering is required, both rigid connections of each sub-array are moved in the opposite direction. To vary the beam width, the rigid connections are moved in the same direction.

FIG. 9 illustrates the embodiment of FIG. 7, except using 3 dB-backward couplers for isolation devices. An array 900 has a first sub-array 901, a second sub-array 910 and center power divider 902 in a symmetric feed arrangement. Each sub-array includes ports 905 leading to antenna elements (not shown), interconnection sections 906 (916), power dividers 907 (917), and reflection-mode phase-shifters 940 (950), respectively. A common sledge structure 920 and 930 are used for each sub-array.

If only beam steering is desired, both driving mechanisms can be coupled to each other and only one actuator is needed. This requires a small realignment of both sub-arrays with respect to each other, such that phase reduction in one sub-array goes together with phase increase in the other sub-array. Referring now to FIG. 10, an exemplary phase-tunable antenna feed network is shown that incorporates a phase-shifter with 3 dB backward couplers and uses a common sledge driving mechanism for array 1000. Array 1000 has a center power splitter 1010, interconnection sections 1015, signal power splitters 1020, phase-shifters 1030, common sledges 1040 and 1045, ports 1060 leading to antenna elements (not shown) and backward couplers 1070. Here a first sub-array 1080 is turned upside down relative to a second sub-array 1085, such that the sledge motion for beam steering is the same for both sub-arrays. The two common sledges 1040 and 1045 are connected via a rigid link as shown in FIG. 8*b*. Thus, common sledges 1040 and 1045, when controlled by a single actuator, can drive first sub-array 1080 and second sub-array 1085, respectively. This driving results in a phase increase in one sub-array and an equal phase decrease in the other sub-array. To implement this embodiment of the present invention, it is further required to have a symmetric response of the reflection-mode phase-shifters with respect to their middle position ($\Delta\phi=0$). This can be obtained by using the phase-shifter with a short termination.

It will be understood that embodiments of the present invention specifically shown and described herein are merely exemplary and that a person ordinarily skilled in the art can make alternate embodiments using different configurations and functionally equivalent components. All such alternate embodiments are intended to be included in the scope of this invention as set forth in the following claims.

What is claimed is:

1. A phase-tunable antenna feed network, comprising:

a plurality of phase-shifters, each said phase-shifter consisting of at least one reflection-mode phase-shifter and an isolation device, said isolation device separating an input signal and a reflected signal for said reflection-mode phase-shifter; and a plurality of signal power splitters that are alternately disposed in series with said plurality of phase-shifters, each said splitter delivering a signal to at least two network elements; and at least one collective drive mechanism to drive more than one of said plurality of phase-shifters.

2. The phase-tunable antenna feed network according to claim 1, further comprising a plurality of interconnection sections coupling said signal power splitters and said phase-shifters, each interconnection section having a substantially same impedance.

3. The phase-tunable antenna feed network according to claim 1, wherein at least one of said network elements is a phase-shifter.

4. The phase-tunable antenna feed network according to claim 1, further comprising:

a first common driving mechanism for driving a first set of said plurality of phase-shifters; and a second common driving mechanism for driving a second set of said plurality of phase-shifters.

5. The phase-tunable antenna feed network according to claim 4, wherein said first common driving mechanism and said second common driving mechanism are coupled together.

6. The phase-tunable antenna feed network according to claim 4, wherein said first common drive mechanism and said second common drive mechanism move in a same direction.

7. The phase-tunable antenna feed network according to claim 4, wherein said first common drive mechanism and said second common drive mechanism move in a different direction.

8. The phase-tunable antenna feed network according to claim 1, wherein said isolation device is a circulator.

9. The phase-tunable antenna feed network according to claim 1, wherein said reflection-mode phase-shifter receives a signal through a transmission line, said transmission line having at least one active line and at least one ground that are disposed in a substantially parallel and spaced relation to one another, said transmission line having a termination at one end, said reflection-mode phase-shifter having at least one conductive construct for sliding along said transmission line and capacitively coupling with at least one of said at least one active line and said at least one ground, wherein said at least one conductive construct behaves as a capacitive shunt and reflects a significant part of the input signal.

10. The phase-tunable antenna feed network according to claim 9, wherein said transmission line is an air-suspended stripline device.

11. The phase-tunable antenna feed network according to claim 9, wherein movement of said at least one conductive construct along said transmission line moves a reflection plane thereof and thereby causes a phase shift in the signal.

12. The phase-tunable antenna feed network according to claim 9, wherein said at least one conductive construct has no electrical contact with said at least one active line and said at least one ground and fills a significant amount of gap between said at least one active line and said at least one ground.

13. The phase-tunable antenna feed network according to claim 9, wherein local capacitance of said transmission line is enhanced at said capacitive shunt, said capacitive shunt acting as a discontinuity to reflect said significant part of the signal.

14. The phase-tunable antenna feed network according to claim 9, wherein said least one conductive construct increases the capacitance of said transmission line over a significant line length, thereby providing a transmission line section with lower impedance that causes reflection at impedance discontinuities with respect to said transmission line section.

15. The phase-tunable antenna feed network according to claim 9, wherein said termination is one selected from the group comprising an electrical short circuit and an electrical open circuit.

16. The phase-tunable antenna feed network according to claim 9, wherein said transmission line is a board-suspended stripline device.

17. The phase-tunable antenna feed network according to claim 9, wherein said transmission line is an air-suspended microstrip device.

18. The phase-tunable antenna feed network according to claim 9, wherein said transmission line is a board-suspended microstrip device.

19. The phase-tunable antenna feed network according to claim 9, wherein said transmission line is a coplanar waveguide device.

20. The phase-tunable antenna feed network according to claim 1, wherein said phase-shifters are voltage-driven.

21. The phase-tunable antenna feed network according to claim 1, wherein said phase-shifters can be driven mechanically or electro-mechanically.

22. The phase-tunable antenna feed network according to claim 1, wherein said plurality of phase-shifters and said plurality of signal power splitters are arranged symmetrically with retard to an input port.

23. The phase-tunable antenna feed network according to claim 1, wherein at least one of said network elements is a signal power splitter.

24. The phase-tunable antenna feed network according to claim 1, wherein at least one of said network elements is an antenna element.

25. The phase-tunable antenna feed network according to claim 1, wherein said isolation device is a backward coupler.

26. The phase-tunable antenna feed network according to claim 1, wherein said isolation device is a quadrature hybrid.

27. A phase-tunable array, comprising:

a plurality of phase-shifters, each said phase-shifter consisting of at least one reflection-mode phase-shifter and an isolation device, said isolation device separating an input signal and a reflected signal for said reflection-mode phase-shifter; and a plurality of power dividers that are alternately disposed in series with said plurality of phase-shifters, each said splitter delivering a signal to at least two network elements; and a collective drive mechanism to drive more than one of said plurality of phase-shifters.

28. The phase-tunable array according to claim 27, further comprising:

a plurality of interconnection sections coupling said power dividers and said phase-shifters, each interconnection section having a substantially same impedance; and a plurality of antenna elements, each being coupled to a corresponding network element.

29. The phase-tunable antenna feed network according to claim 27, wherein at least one of said network elements is a phase-shifter.

30. The phase-tunable array according to claim 27, further comprising:

a first common driving mechanism for driving a first sub-array of phase-shifters in a first direction; and a second common driving mechanism for driving a second sub-array of said plurality of phase-shifters in a second direction.

31. The phase-tunable array according to claim 30, wherein said first common driving mechanism and said second common driving mechanism are coupled together.

32. The phase-tunable array according to claim 27, wherein said reflection-mode phase-shifter receives said input signal through a transmission line that has at least one active line and at least one ground that are disposed in a substantially parallel and spaced relation to one another, said transmission line having a termination at one end thereof, said reflection-mode phase-shifter having at least one conductive construct for sliding along said transmission line and capacitively coupling with at least one of said at least one active line and said at least one ground, wherein said at least one conductive construct behaves as a capacitive shunt and reflects a significant part of the input signal.

33. The phase-tunable array according to claim 32, wherein said transmission line is an air-suspended stripline device.

34. The phase-tunable array according to claim 32, wherein movement of said at least one conductive construct along said transmission line moves a reflection plane thereof and thereby causes a phase shift in the signal.

35. The phase-tunable array according to claim 34, wherein local capacitance of said transmission line is enhanced at said capacitive shunt, said capacitive shunt acting as a discontinuity to reflect said significant part of the signal.

36. The phase-tunable array according to claim 35, wherein said at least one conductive construct increases the capacitance of said transmission line over a significant line length, thereby providing a transmission line section with lower impedance that causes reflection at both impedance steps with respect to said transmission line section.

37. The phase-tunable antenna feed network according to claim 32, wherein said transmission line is a board-suspended stripline device.

38. The phase-tunable antenna feed network according to claim 32, wherein said transmission line is an air-suspended microstrip device.

39. The phase-tunable antenna feed network according to claim 32, wherein said transmission line is a board-suspended microstrip device.

40. The phase-tunable antenna feed network according to claim 32, wherein said transmission line is a coplanar waveguide device.

41. The phase-tunable array according to claim 27, wherein said isolation device is a circulator.

42. The phase-tunable array according to claim 27, wherein said plurality of phase-shifters and said plurality of signal power splitters are arranged symmetrically with regard to an input port.

43. The phase-tunable antenna feed network according to claim 27, wherein at least one of said network elements is a signal power splitter.

44. The phase-tunable antenna feed network according to claim 27, wherein at least one of said network elements is an antenna element.

45. The phase-tunable antenna feed network according to claim 27, wherein said isolation device is a backward coupler.

46. The phase-tunable antenna feed network according to claim 27, wherein said isolation device is a quadrature hybrid.

* * * * *